United States Patent [19]

Wunner

[11] Patent Number: 4,723,424

[45] Date of Patent: Feb. 9, 1988

[54] PROCESS AND DEVICE TO OPERATE A WARP KNITTING MACHINE, IN PARTICULAR A STITCH-BONDING MACHINE

[75] Inventor: Roland Wunner, Schwarzenbach/Wald, Fed. Rep. of Germany

[73] Assignee: Liba Maschinenfabrik GmbH, Naila, Fed. Rep. of Germany

[21] Appl. No.: 943,614

[22] Filed: Dec. 18, 1986

[30] Foreign Application Priority Data

Jun. 16, 1986 [DE] Fed. Rep. of Germany ..... 3620259

[51] Int. Cl.[4] ..... D04B 23/06

[52] U.S. Cl. ..... 66/85 A; 66/208; 66/203

[58] Field of Search ..... 66/84 A, 85 A, 84, 85, 66/208, 203

[56] References Cited

U.S. PATENT DOCUMENTS 3,688,524 9/1972 Peschl et al. ..... 66/208
4,399,670 8/1983 Hittel et al. ..... 66/84 A

FOREIGN PATENT DOCUMENTS 85832 5/1963 Czechoslovakia ..... 66/208
1123707 8/1968 United Kingdom ..... 66/208

*Primary Examiner*—Ronald Feldbaum
*Attorney, Agent, or Firm*—Dority & Manning

[57] ABSTRACT

This invention relates to a stitch-bonding warp knitting machine and a process for operating it. The stitch-bonding warp knitting machine comprises a plurality of knitting needles that pierce a continuously conveyed band of material. The knitting needles are driven by two different reciprocating motions, one of which reciprocates the needles along their longitudinal axis and the other of which swivels said knitting needles about an axis. The invention also includes means for continuously conveying a band of material through a point in the path of said reciprocating knitting needles. The reciprocating action of the needles and the swivelling action about an axis remote from the point that said band of material passes is such that said knitting needles pierce said band of material and at the same time move in a transverse direction in the direction that said band of material is moving and at the same speed of movement all of the time that said needles are penetrating through said band of material. The knitting needles are then withdrawn from the band of material after having a warp yarn wrapped around the needles, thereby drawing loops of said warp yarn through said band of material and through previously formed loops of warp yarn. After the needles are withdrawn from the band of material, they are moved transversely in a direction opposite to the direction of movement of said band of material in preparation for a new penetration remote from the point that first penetration took place.

11 Claims, 3 Drawing Figures

PROCESS AND DEVICE TO OPERATE A WARP KNITTING MACHINE, IN PARTICULAR A STITCH-BONDING MACHINE

BACKGROUND OF THE INVENTION

The invention concerns a process and a device to operate a warp knitting machine, in particular a stitch-bonding machine with knitting elements, the knitting needles of which pierce a continuously fed fabric web and thereby carry out the knitting process.

A machine of this kind, used in addition to knit weft yarns into the finished fabric, is described in German Offenlegensschrift No. 2 316 160. The weft yarns are, in this case, conveyed to the knitting elements by means of a conveyor driven at uniform speed. This also applies to the band of material which advances constantly at the same speed.

In this type of operation, the knitting needles interrupt the continuous conveying of the band of material for as long as they are pierced into same. If the distance from one knitting stitch to the next knitting stitch is relatively long, this can lead to a jamming of the band of material.

Furthermore, the European patent application No. 0 018 766 discloses a stitch-bonding machine to which a fiber fleece is fed, constituting the band of material, whereby the fleece is held up for as long as it is pierced by the needles. However, this requires a corresponding, step-by-step manner of driving the fleece, and this is again undesirable because it can cause irregularities in the goods produced.

It is the object of the instant invention to solve these problems. According to the invention this is accomplished by superimposing a transversal movement to the movement of the knitting needles, parallel to the direction of advance of the band of material, lasting from the moment of their introduction into the material to the moment of their exiting the material, of such nature as to cause the knitting needles to follow the band of material essentially at the speed of the band of material for as long as they are in contact with said band of material, and to cause said needles to be brought back, at an offset position in relation to the band of material, to their starting position before their introduction into the material again.

Because of this superimposed movement of the knitting needles, the latter exert no pull on the continuously conveyed band of material, neither against nor in the direction of advance, resulting in a particularly smooth operation and making it possible to obtain without difficulty, longer distances between stitches, in the direction of advance.

The imparting of swivelling movement counter to the running direction to the knitting needles and to the yarn guides in order to reduce the forces of acceleration in a warp knitting machine in which no band of material is fed, so that the relative movement remains the same in its effect, whereby each attributed bar, however, has to execute a correspondingly shortened movement, is known from German Patentschrift No. 1 585 173. The movement of the knitting needles in this case is such that as they rise, they do not carry out any advance movement, so that a corresponding pull is exerted by the knitted band of material upon the knitting needles due to the draw-off of the fabric as the needles rise. Also, while the knitting needles descend, they are moved in the direction opposite to the draw-off movement of the knitted band of material, thus obviously further increasing the pull exerted by the band of material upon the knitting needles. If this principle of movement were to be transferred to a stitch-bonding machine, it would result in a pull in a direction opposite to the advance of the conveyed band of material and this would interfere considerably with the stitch-bonding process.

German Patentschrift No. 1 585 238 discloses an application of the above-described principle of relative movement to a warp knitting machine provided with a trace comb and operating without a band of material being presented, whereby the trace comb can be held free of motion. The movement of the knitting needles, in this case, takes place in principle as described above for German Patentschrift No. 1 585 173, whereby the range movement of the knitting needles, however counter to the direction of draw-off, is shortened. In case of application of this principle to a warp knitting machine with conveyed band of material, the up and down movement of the knitting needles would be accompanied by a stoppage of the band of material in every instance.

Aside from the fact the neither German Patentschrift No. 1 585 173 nor German Patentschrift No. 1 585 238 contain any reference to stitch-bond knitting in connection with a represented band of material, it should be pointed out that the sequences of movement disclosed in both patent publications are unsuitable for stitch-bonding machines.

SUMMARY OF THE INVENTION

The above mentioned superimposition of movement can be obtained advantageously by bringing about the transversal movement and the movement of return of the knitting needles by means of a swivelling movement of the needle bar around a swivelling axis which is offset in relation to the band of material. The movement of the slide bar is then effected so that said slide bar is made to follow the swivelling motion of the needle bar. Preferably, the swivelling movement can be adjusted by setting the swing angle.

In a preferred embodiment of a warp knitting machine to carry out the above-described process, the swivelling movement is obtained by seating the needle bar on rams which slide back and forth in an axial direction and which are coupled to the swivelling shaft in such manner as to be twisted to the extent of the swing angle during the swivelling motion. The rams and the swivelling axis can be combined in this embodiment so that rams go diametrically through the swivelling axis.

In order to bring about the swivelling movement of the swivelling shaft, a radially extending lever is preferably attached to the swivelling shaft, whereby a ram capable of back-and-forth movement is linked to said lever via a shank. To make a setting of the swing angle possible, the shank is attached slidingly and radially in relation to the swivelling axis.

To impart the same movement to the slide bar as to the needle bar, the slide bar is supported on rams which are moved back and forth and are coupled to the needle bar in such a manner as to execute the same swivelling motion as the needle bar.

It is also possible to attach a knock-over bit to the lever which twists the swivel axis, so that said knock-over bit also executes the swivelling movement of the swivelling axis and thereby that of the needle bar.

DESCRIPTION OF THE DRAWINGS AND PREFERRED EMBODIMENTS

An example of an embodiment of the invention is shown in the figures.

DETAILED DESCRIPTION OF THE PREFERRED EMBODIMENTS

Figure 1:
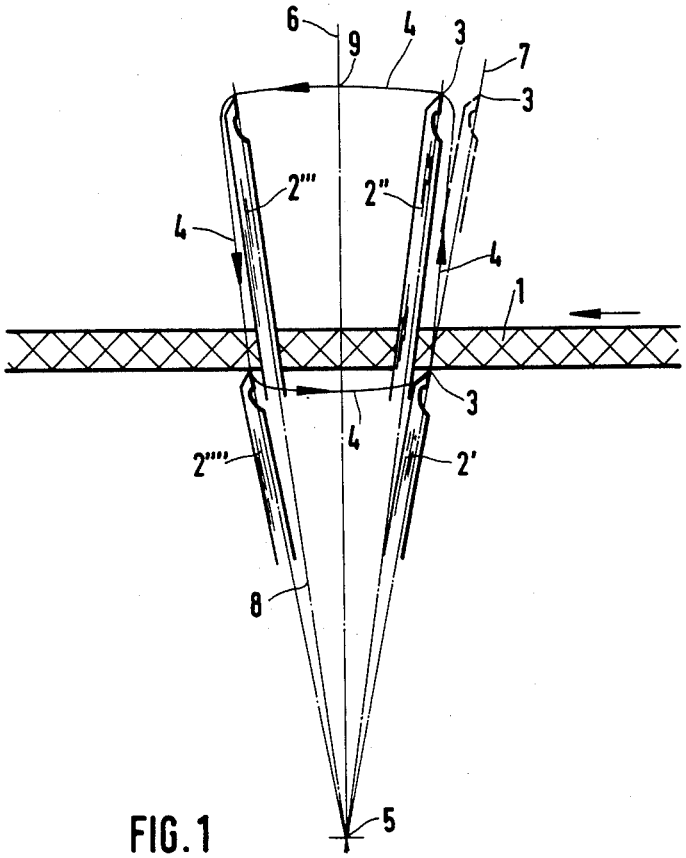
FIG. 1 is a schematic representation of the movement of a knitting needle in relation to a presented band of material.

FIG. 1 shows the band of material 1, a nonwoven fiber fleece for example, being conveyed continuously in the direction of the arrow to the knitting elements of a stitch-bonding machine. A warp yarn is knitted in the known manner into the band of material 1 by means of knitting needle 2, said warp yarn being omitted in the drawing for reasons of clarity, as only the movement of the knitting needle 2 is being studied here. Furthermore, the slide or contact working together in the known manner with the knitting needle 2 has been left out for clarity. The knitting needle 2 is moved by a drive mechanism shown in FIG. 2, whereby its needlepoint 3 follows the path 4 which needlepoint 3 penetrates in the direction of the arrows drawn into path 4. Along path 4, the knitting needle 2 assumes the positions designed by 2', 2'', 2''' and 2'''' and drawn in FIG. 1. From the drawn-in positions of the knitting needle 2, it appears clearly that said knitting needle 2, starting from its position 2' pierces the presented band of material 1 with its point 3 and, at the end of this piercing movement, assumes the position designated by 2'', whereupon the knitting needle 2 changes position to assume position 2''' while in this piercing mode, whereby the knitting needle 2 is pushed forward with the advancing movement of the band of material 1 essentially the same speed. The transition from position 2''' to position 2'''' whereby the knitting needle 2 is withdrawn from the band of material 1. The knitting needle 2 then changes over from position 2'''' to position 2' without being in contact with the band of material 1, i.e. it is fed back from the band of material 1 in offset position to the starting position 2', in which it was before entering the material. The above-described processes of piercing and feed-back after piercing are known knitting processes, whereby the known overlaying and underlaying of the warp yarn takes place of course, but this is not discussed in this context as it does not have any bearing upon the movement of the knitting needle 2 shown here. The associated yarn guide must, of course, execute a swinging movement that is suitably adapted. This, as well as the guidance of the warp yarn, is illustrated through the drawing of FIG. 3.

Figure 2:
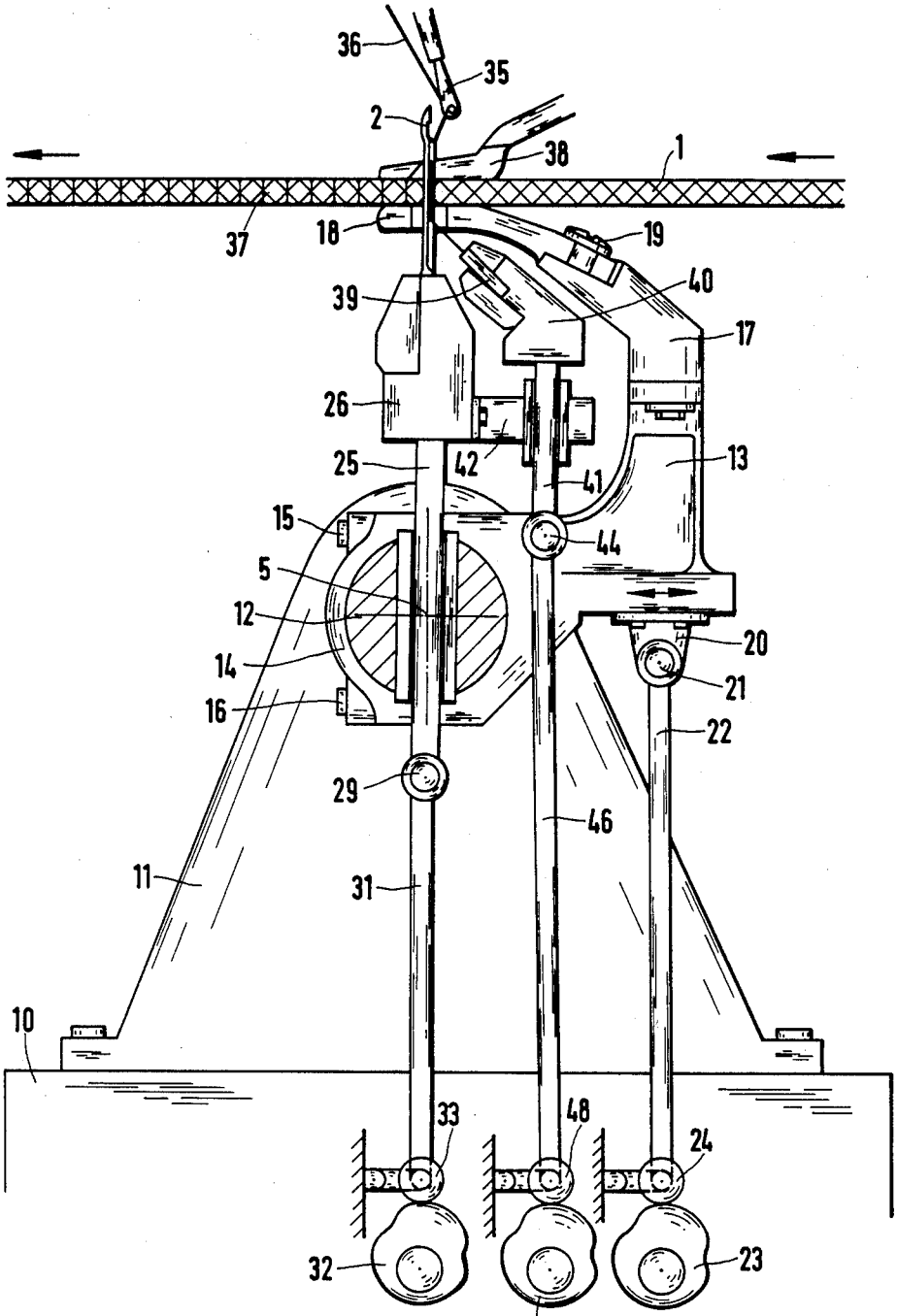
FIG. 2 shows the driving mechanism for the knitting elements.

As shown in FIG. 1, the movement of the knitting needle 2, as it is introduced into the material and emerges from it, is based on a movement starting from a central point 5 which, as explained in greater detail in connection with FIG. 2, is due to the fact that the knitting needle 2 is supported on a swivelling lever which is swivelled back and forth around an axis having a central point 5. Although the knitting needle 2 then each time assumes a different position, at an angle to the band of material 1, this is negligible as far as the band of material 1 is concerned because point 5 is so far removed from the band of material 1 that no angled position of any practical importance is assumed by the knitting needle 2 with respect to the band of material 1. In other words, this is a process of introduction and exit of the knitting needle 2 which closely resembles that of stitch-bonding machines, without the superimposed movement in the direction of advance, that is to say in which the needle enters and exits at a vertical angle to the band of material.

The fact that the knitting needle, in the instant case, is also moved in the direction of advance of the band of material 1 as it changes over from position 2' to position 2'' is shown in the following manner: If the knitting needle 2 were to be moved from position 2' in direction of its longitudinal axis along the broken line 7 into the position on line 7 which is indicated by a broken line, the resulting path of movement of the knitting needle 2, as it pierces the band of material 1, would lack any superimposed movement in the direction of advance of the band of material 1. FIG. 1 now shows by means of the drawn representation of position 2'' that the point 3 is actually shifted from the position represented by a broken line to position 2'', i.e. the knitting needle 2 has also executed a superimposed movement in the direction of advance of the band of material 1 on its way from position 2' to position 2'', in addition to its piercing movement. A similar principle applies to the movement of the knitting needle 2 as it changes over from position 2''' into position 2''''. If the knitting needle were to be pulled out of the band of material 1 as it goes from position 2'''', into position 2'''', without superimposition of any movement in the direction of advance (i.e. in direction of line 8), no superimposed movement would occur as this movement takes place. In fact, however, FIG. 1 shows that the knitting needle 2 has been shifted to the left, in direction of advance of the band of material 1, when comparing position 2'''' with position 2''', i.e. the knitting needle 2 has executed a movement in which a movement in direction of advance of the band of material has been superimposed on the movement of exiting the material.

Path 4 follows a slight curve within the transition zone between position 2'' and position 2''', and this means that during this transition, the knitting needle 2 at first carries out a short movement in the direction of its introduction into the material, and this up to the intersection 9 of path 4 and median line 6, whereupon the movement in the longitudinal direction of knitting needle 2 is reversed, thereby initiating the exiting phase of the needle, which then takes place entirely within the range of path 4 as the change-over from position 2''' into position 2'''' takes place. The curvature of the path 4 in the area of intersection point 9 is a measure for the remaining movement of the knitting needle 2 in its longitudinal direction during the change-over from postion 2'' into position 2'''. It should be noted, however, that this zone of path 4 can also be designed differently, for example, the mechanism for the movement of the knitting needle 2 can be fashioned so that said knitting needle is held fast to limit its depth of penetration into the band of material 1 after reaching position 2''.

FIG. 2 shows the mechanism which drives the knitting elements in accordance with the principles shown in FIG. 1.

According to FIG. 2, the pillow block 11 in which the swivelling shaft 12 is supported is screwed to the machine frame 10. A lever 13 is clamped fast on the shaft 12 by means of cover 14 and the two screws 15 and 16. In this way, the lever 13 is connected solidly to shaft 12 so as to rotate with it. Lever 13 supports the knockover bar 17 to which the knockover bits 18 are attached in the known manner by means of screws 19. The knockover bits 18 follow the movement of the lever 13 because of the shown connection with said lever. It should, however, be pointed out that the knockover bar 17 with the knockover bits 18 can also be fixed.

Shank 20 is screwed to lever 13 and connecting rod 22 is articulatedly connected to said shank via axis 21. Connecting rod 22 is shifted back and forth axially by follower 24 by means of the cam plate 23, whereby the lever 13 executes a swivelling movement around the center 5 of the swivelling shaft 12. The amplitude of this swivelling movement can be adjusted at will by lateral shifting of the shank 20 in relation to lever 13.

The swivelling shaft 12 is traversed by the push bar 25, whereby push bar 25 is supported in the swivelling shaft 12 so that it can slide along its longitudinal axis and is essentially free from play. At the end of the push bar 25, the needle bar 26 from which the knitting needles emerge, is attached. The push bar 25 is connected via joint 29 to the connecting rod 31 which is pushed back and forth in longitudinal direction by cam 32 and follower 33. In this embodiment, the joint 29 ensures that swivelling of the push bar 25 is compensated in relation to the connecting rod 31 through rotation of swivelling shaft 12 (discussed in further detail below). Due to the axial back-and-forth movement of connecting rod 31, the slide needles 2 are moved up and down, i.e. they are pushed into the band of material 1 and are pulled out of same.

In order to impart a lateral movement, parallel to the direction of advance of the band of material 1, to the vertical movement of the knitting needles 2 as they enter and exit the material, the swivelling shaft 12 is turned back and forth in the above described manner by means of lever 13, whereby the knitting needles 2, as shown in FIG. 1, are swivelled correspondingly, i.e. around the center 5 of the swivelling shaft 12 which is shown as center 5 according to FIG. 1. Because of the relatively great distance between the knitting needles 2 and the center 5, a movement essentially in direction of advance of the band of material results during swivelling of the knitting needles 2, and in the opposite direction to this advance, as was described through FIG. 1.

Due to the axially shiftable support of the push bar 25 in the shaft 12 which is turned back and forth, a movement is created along path 4, shown in FIG. 1, whereby this movement comprises the movements of introduction and exit of the knitting needles 2, and in addition the superimposed movement in the direction of and against the direction of, advance of the band of material 1.

In addition to the push needles 2, FIG. 2 also shows an associated yarn guide 35 through which yarn 36 is pulled and is overlaid and underlaid in the known manner by said guide 35 to form the stitches 37 which are pulled through the band of material 1. FIG. 2 furthermore shows a known holding-down device 38 which extends between the knitting needles 2 having entered the material and ensures that the presented band of material 1 is not lifted off the knockover bits when the knitting needles 2 penetrate it.

FIG. 2 furthermore shows the slider 39, supported on the slide bar 40 and working together with the knitting needle 2 which is made in the form of a push needle. The slide bar 40 is attached at the end of push bar 41 which is supported essentially free of play and slidably in the axial direction in arm 42 attached on the needle bar 26. Push bar 41 is connected via joint 44 to connecting rod 46 to which is imparted an axial back-and-forth movement by means of cam disk 47 via follower 48. This back-and-forth movement produces the known back-and-forth movement of slider 39 in relation to the push needle 2 to close and open the hook of the push needle 2, whereby a movement in the direction of, and against the direction of, advance of the band of material 1 is superimposed upon this movement of slider 39 by means of the back-and-forth swivelling of arm 42, which follows precisely the back-and-forth swivelling of the needle bar 26. This ensures that the swivelling motion of needle 2 is translated into a corresponding swivelling motion of the slider 39, whereby this swivelling motion manifests itself essentially in a superimposed motion within the area of the band of material 1, either following the direction of advance of the band of material 1 or directed in the opposite direction of said advance.

Joint 44 thereby compensates for the swivelling movement of the push bar 41 in relation to rod 46 in the same manner as the earlier described joint 29.

The cam disks 32, 47 and 23 are driven via the main shaft of the stitch-bonding machine, thereby ensuring synchronism in driving the elements driven by these cam disks.

It should be pointed out that the above-described support of the swivelling shaft 12, alongside the machine frame, is effected at several locations, just as connecting rods 31, 46 and 22 as well as push bars 25 and 41 are provided with multiple supports in order to give the entire installation a required degree of stability. This also applies to lever 13 and arm 42.

Figure 3:
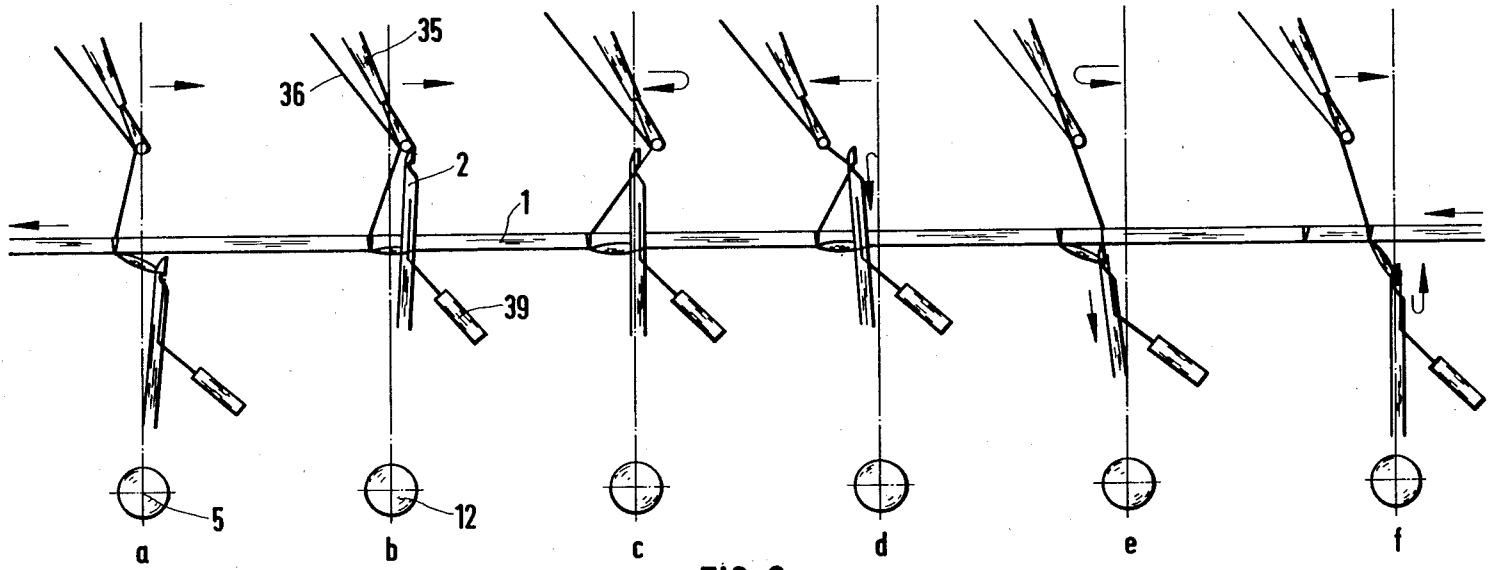
FIG. 3 shows diagrammatically, individual steps of the stitch-bonding operation.

The succeeding phases of operation a to f during the movement of push needle 2, slider 39 and yarn guide 35 are shown in FIG. 3.

During operating phase a, the push needle 2 starts to enter the band of material 1. When it has penetrated, in phase b, the warp yarn 36 is overlaid in phase c. The push needle 2 is now simultaneously shifted in direction of advance of the band of material (superimposed movement). In phase d, the push needle 2 then reaches its forwardmost position of its superimposed movement from which it is pulled out of the band of material 1, warp yarn 36 being taken along, until it is completely withdrawn from the band of material 1 in phase e, having pulled a stitch through the band of material 1. The push needle 2 is then shifted from this position counter to the direction of advance of the band of material 1, below said band, so that it finally comes into phase a via phase f, whereby a stitch is laid beneath the band of material 1. The stitch-bonding process then starts anew.

It will be understood, of course, that while the form of the invention herein shown and described constitutes a preferred embodiment of the invention, it is not intended to illustrate all possible form of the invention. It will be understood that the words used are words of description rather than of limitation and that various changes may be made without departing from the spirit and scope of the invention herein disclosed.

What is claimed is:

1. A process for operating a stitch-bonding warp knitting machine, having knitting needles that pierce a continuously conveyed band of material, comprising the steps of:

(a) penetrating said band of material with said knitting needles;

(b) moving said knitting needles through said band of material, while at the same time moving said knitting needles transversely at the same speed and in the same direction that said band of material is moving;

(c) wrapping warp yarns about the hooks of said needles while they move transversely with said band of material;

(d) drawing loops of said warp yarns through said band of material by withdrawing said needles from said band of material while at the same time moving said needles transversely at the same speed of, and in the same direction as said band of material is moving; and (e) pulling said loops of warp yarns through previously formed loops of said warp yarns while at the same time moving said needles transversely in a direction opposite to the direction said band of material is moving, in preparation for penetrating said band of material at a point removed from the point of previous penetration.

2. A process for operating a stitch-bonding warp knitting machine as set forth in claim 1, wherein the transverse movement of the knitting needles and their return movement is effected by a swivelling movement of said needles around a swivelling axis which is offset from the band of material.

3. A process for operating a stitch-bonding warp knitting machine as set forth in claim 2, wherein slides for said knitting needles follow the swivelling movement of the needles.

4. A process for operating a stitch-bonding warp knitting machine as set forth in claim 2, wherein the swivelling movement is adjustable.

5. A stitch-bonding warp knitting machine, comprising:

(a) means for continuously conveying a band of material;

(b) a plurality of warp knitting needles for piercing said continuously conveyed band of material;

(c) means for guiding said band of material in the path of said knitting needles;

(d) means for reciprocating said needles along their longitudinal axis; and (e) means for swivelling said knitting needles about a swivelling axis while said needles are being reciprocated along their longitudinal axis so as to move said knitting needles transversely in the direction of the band of material movement during the time that said material is penetrated by said knitting needles and moving said knitting needles transversely in a direction opposite the direction of movement of said band of material while said knitting needles are outside of said band of material.

6. A stitch-bonding warp knitting machine as set forth in claim 5, wherein the knitting needles are carried by a needle bar which is operatively associated with a connecting rod which provides the reciprocating motion along the longitudinal axis of said needles, said rod being connected to a shaft which pivots around said swivelling axis during the swivelling movement of said needles to the extent of the swing angle.

7. A stitch-bonding warp knitting machine as set forth in claim 6, wherein the connecting rod passes through the swivelling shaft along its diameter.

8. A stitch-bonding warp knitting machine as set forth in claim 6, wherein a radially extending lever is attached to the swivelling shaft and said radially extending lever is connected to a reciprocating connecting rod.

9. A stitch-bonding warp knitting machine as set forth in claim 8, wherein the connection between said lever and said connecting rod is adjustable radially in relation to the swivelling shaft so as to permit adjustment of said swivelling shaft.

10. A stitch-bonding warp knitting machine as set forth in claim 6, wherein a slide bar is supported on reciprocating connecting rod which is associated with said needle bar to execute the same swivelling motion as said needle bar.

11. A stitch-bonding warp knitting machine as set forth in claim 8, wherein a knock-over bit is attached to said radially extending lever.

* * * * *